US005181873A

United States Patent [19]

Tolbert

[11] Patent Number: 5,181,873

[45] Date of Patent: Jan. 26, 1993

[54] WATER SPORT FOOTWARE

[76] Inventor: James H. Tolbert, 106 Winfield Cir., Newport News, Va. 23601

[21] Appl. No.: 772,065

[22] Filed: Oct. 7, 1991

Related U.S. Application Data

[63] Continuation-in-part of Ser. No. 324,732, Mar. 17, 1989, Pat. No. 5,078,633, which is a continuation-in-part of Ser. No. 784,577, Oct. 4, 1985, abandoned.

[51] Int. Cl.[5] ..... B63B 35/81

[52] U.S. Cl. ..... 441/65; 36/114

[58] Field of Search ..... 441/65, 68, 79, 76, 441/77, 70, 61; 36/25 R, 30 R, 114, 115, 85, 88

[56] References Cited

U.S. PATENT DOCUMENTS

| | | | |
|---|---|---|---|
| 2,229,387 | 1/1941 | Parker | 36/30 R |
| 2,349,866 | 5/1944 | Heck | 36/30 R |
| 4,366,634 | 1/1983 | Giese et al. | 36/114 |
| 5,078,633 | 1/1992 | Tolbert, Jr. | 441/65 |

FOREIGN PATENT DOCUMENTS

| | | | |
|---|---|---|---|
| 218779 | 4/1987 | European Pat. Off. | 441/68 |
| 925359 | 5/1982 | U.S.S.R. | 441/76 |
| 8304166 | 12/1983 | World Int. Prop. O. | 36/115 |

*Primary Examiner*—Sherman Basinger
*Attorney, Agent, or Firm*—Keaty & Keaty

[57] ABSTRACT

The invention relates to improved water sport footwear designed for wearing during gliding on the surface of water with the bottom of the footwear contacting the water during the gliding process. The footwear includes a boot portion and a sole assembly which is fixedly attached to the boot portion. The size of the sole assembly is not considerably greater than the boot portion itself. The sole assembly is formed from with a rigid upper plate and a soft, impact absorbing bottom plate, the bottom surface of which contacts the water. A continuous shoe portion mounting wall extends upwardly from the top plate and defines an area within which the shoe portion is secured to the top plate and the mounting plate. The mounting wall is formed unitary with the upper plate and the bottom, and upper plates and the mounting wall form a composite unitary sole assembly.

9 Claims, 2 Drawing Sheets

WATER SPORT FOOTWARE

CROSS REFERENCE TO RELATED APPLICATIONS

This application is a continuation-in-part application of my co-pending application Ser. No. 324,732 Filed: Mar. 17, 1989 for "Water Sport Footwear", now U.S. Pat. No. 5,078,633 issued on Jan. 7, 1992, which is a continuation-in-part application of application Ser. No. 784,577 Filed on Oct. 4, 1985 for "Water Ski Shoes", now abandoned, the disclosures of both of the applications are being incorporated herewith by reference.

BACKGROUND OF THE INVENTION

The present invention relates to footwear for water sports, and more specifically to footwear worn during gliding on the body of water, while the user is being pulled along the body of water by a motor boat or the like.

In the present years it has become popular to engage in barefoot waterskiing, which presents considerable danger to the feet of the skier. In barefoot waterskiing, a sportsman holds by hands on to a pulling rope, while contacting the surface of water with his bare feet, and is being propelled about the surface of water at considerable speed. Various mechanical objects in the body of water, such as wooden splinters, pieces of plastic containers and the like which float in the body of water can damage the feet of the sportsman, causing serious injuries.

There are also known various elongated skies in which conventional water ski shoes of the sportsman are secured by clamps or similar means which allows the sportsman to engage in conventional water skiing sports. But as with bare foot skiing, there is present a danger of injury to a sportman, such as when a sportsman falls, the ski may become the damaging object, causing injury to the sportsman, breaking and leaving the broken pieces on the surface of the water, so that the next skier is injured by the broken skis.

The present invention contemplates provision of water sport footwear which overcomes deficiencies of the prior art and provides a safe alternative to barefoot skiing, allowing the user to glide on the body of water while wearing the footwear without the assistance of water skis.

It is, therefore, an object of the present invention to provide a water sport footwear capable of absorbing impact shocks acting on a sportsman's foot during contact with water.

It is another object of the present invention to provide a water sport footwear having an improved breakage resistance, which is lightweight and resists bending.

It is a further object of the present invention to provide a water sport footwear which has improved hydrodynamic qualities.

It is still a further object of the present invention to provide a water sport footwear which protects the foot of the sportsman, as it comes in contact with the body of water during gliding on the surface of the water.

These and other objects of the invention will be more apparent to those skilled in the art from the following description of the invention.

SUMMARY OF THE INVENTION

The present invention achieves its objects and overcomes its deficiencies of the prior art in a simple and straightforward manner. The present invention contemplates provision of a water sport footwear which comprises a sole assembly and a boot portion fixedly attached to the sole assembly, while the sole assembly is not considerably greater than the boot portion itself. The sole assembly comprises a soft, flexible bottom plate, a substantially rigid upper plate which is fused to the bottom plate and a substantially continuous upwardly extending shoe mounting wall secured to a top surface of the upper plate.

The bottom surface of the contact (bottom) plate immediately contacts the body of water during entire water gliding by a sportsman, absorbing contact forces, while the upper plate supports the boot portion, fixedly engaging it, with the boot portion extending upwardly to a distance adjacent an ankle of the sportsman.

The boot portion fits within an area defined by the mounting wall and is fixedly attached thereto at the lower part of the boot portion. The boot portion is sized and shaped to follow natural size and shape of the sportsman's foot, so as to provide comfortable protection to the sportsman's foot without bulky support means, such as conventional water skis. The sole assembly provides improved stability and hydrodynamic qualities. One or more water channels formed in the bottom of the contact plate, at least one of the channels extending from the heel portion to a distance from the front portion gradually reducing in depth towards its innermost end.

There may be further included a pair of channels in the soft and flexible bottom plate along the front half of the shoe for providing improved control and maneuverability while skiing in the reversed position.

The upper plate has a smaller surface area than the bottom plate, such that a continuous border is formed between an outer peripheral edge of the bottom plate to further absorb any impact forces acting on the footwear.

The sole assembly has upwardly curved front and heel portions, with the front portion being curved upwardly to a greater degree than the heel portion. An upwardly turned arch portion further enhances comfort of using the water sport footwear while gliding on the water surface. The boot portion can be secured to the sportsman's feet by securing straps and/or laces.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
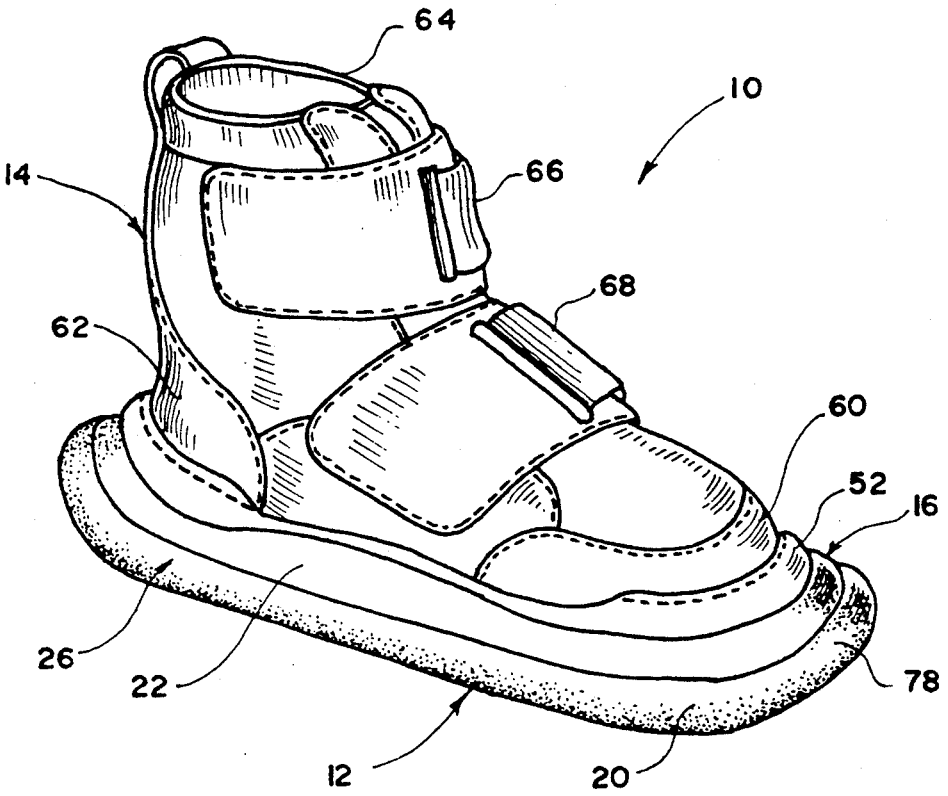
FIG. 1 is a perspective view of the water sport footwear in accordance with the present invention.

Reference will now be made to the drawings, wherein the water sport footwear in accordance with the present invention is generally designated by numeral 10. The footwear 10 comprises a sole assembly 12 and a boot, or shoe portion 14 which is fixedly attached to the sole assembly 12 by adhesion, stitching or other similar methods.

The size of the sole assembly 12 is not considerably greater than the boot portion 14, which rests on a top surface 16 of the sole assembly 12. The bottom surface 18 of the sole assembly 12 is designed for gliding on the surface of water during the entire water gliding process, as will be described in more detail hereinafter.

The sole assembly 12 comprises two plates or layers 20 and 22, which are fixedly and integrally attached to each other to prevent their disengagement during use of the footwear 10. The plates 20 and 22 are attached by reactive injection molding, which fuses the materials, from which the plates are constructed.

Figure 3:
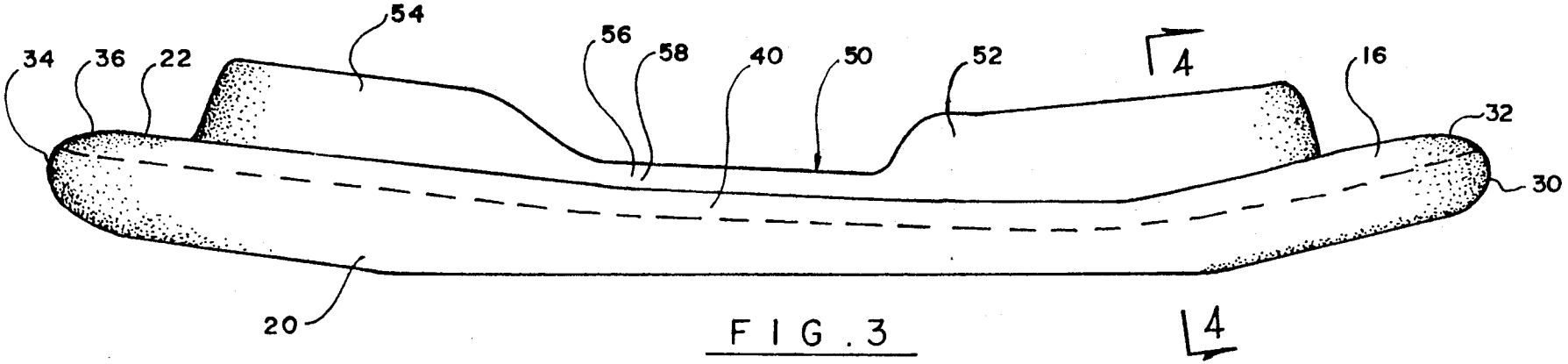
FIG. 3 is a side view of the sole assembly.

As can be seen in FIGS. 1 and 3, the sole assembly 12 comprises a bottom plate 20 made from a relatively soft flexible material, for example polyurethane having 0.4 (0.33 g/cc) density. The soft plate 20 can be made by using compounds SES-5624 (resin) and ISO compound ES-12. The plate 22 is made from a much stronger material, for example polyurethane having 0.9 (0.85 g/cc) density. This material can be made from a resin compound SES-5506 and ISO compound MF-192. The materials mentioned above are manufactured by ICI polyurethane Co. of Sterling Heights, Mich.

Figure 5:
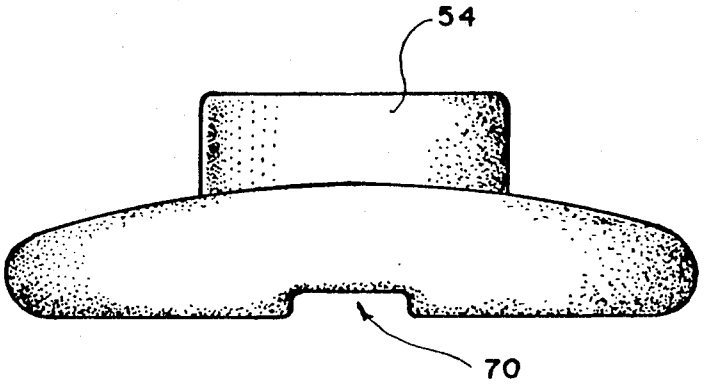
FIG. 5 is a back view of the sole assembly shown in FIG. 3.

The bottom plate 20 has a bottom surface 18 which contacts the water surface and a top surface 26 which engages the lower surface 23 and sides 28 and 29 of the upper plate 22. A recess or depression 27 is made in the surface 26, the recess being sized and shaped to accommodate the entire lower surface and sides of the plate 22. The recess 27 has a smaller periphery than the surface 26, as can be better seen in FIGS. 4 and 5.

The lower plate 20 has a somewhat greater surface than the upper plate 22, so that a continuous peripheral border 78 is formed between the outer peripheral edges of the lower plate 20 and the outer peripheral edges of the upper plate 22.

The plates 20 and 22 each have a front part 30 and 32, respectively, and a back part 34 and 36, respectively. The plate 22 gradually increases in thickness, or height from part 32 to part 36, so that an arch 40 is formed to make the footwear 10 more comfortable to the user. The arch 40 generally follows the natural arch curvature of the human sole of the foot.

Extending upwardly from the top surface 16 of the plate 22 and integrally formed therewith is a shoe mounting wall 50. The wall 50 is a substantially continuous wall and comprises a toe securing part, or protector 52, a heel securing part or protector 54 and a pair of opposing side wall parts 56 and 58 which extend between the parts 52 and 54. The toe securing part 52 and the heel securing part 54 are both arched in shape and are adapted for securing to the front, toe portion 60 of the shoe portion 14 and to the heel, back portion 62 of the shoe portion 14, respectively.

The wall 50 defines and area within which the shoe portion 14 is mounted. As can be seen in the drawings, the periphery of the wall 50 is somewhat smaller than the periphery of the plate 22, such that the sole assembly extends around the shoe portion 14 and protects the human foot from impact with water or foreign objects.

The shoe portion 14 is fixedly secured by adhesion and/or stitching on top of the upper plate 22, between the heel and front protectors 52 and 54 and side wall portions 56 and 58. The boot portion 14 generally follows a shape of a human foot and extends with its upper portion 64 to about an ankle of a sportsman. The boot portion 14 is secured on the user's foot through the use of straps 66 and 68, which can be used in combination with laces, or separately. The strap 68 secures the instep part of the boot portion 14, while the strap 66 secures an ankle or upper portion of the footwear 10.

The securing straps 66 and 68 can vary in width and may utilize hook and loop fasteners, such as Velcro ®, or buckle, if so desired.

Figure 4:
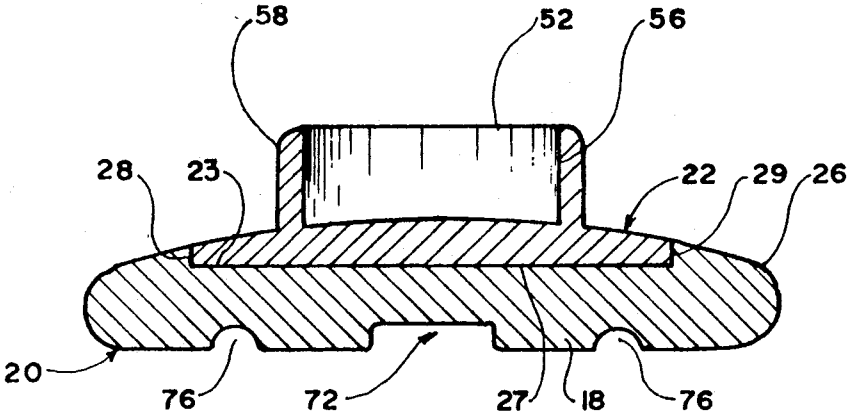
FIG. 4 is a cross-sectional view taken along lines 4—4 of FIG. 3.

Reference will now be made to FIGS. 3 and 4, illustrating the sole of the footwear in accordance with the present invention. The sole assembly 12, as was discussed above has an upper surface 16 and a bottom surface 18. The bottom surface 18 is provided with a central water channel 70 which extends from the heel portion 34 inwardly towards the front portion 30 and terminates a distance from the front portion 30 of the plate 20. The depth of the channel 70 generally decreases from the heel part 34 towards its innermost end 72, so that the channel 70 gradually meets with the bottom surface 18 at its innermost end.

Figure 2:
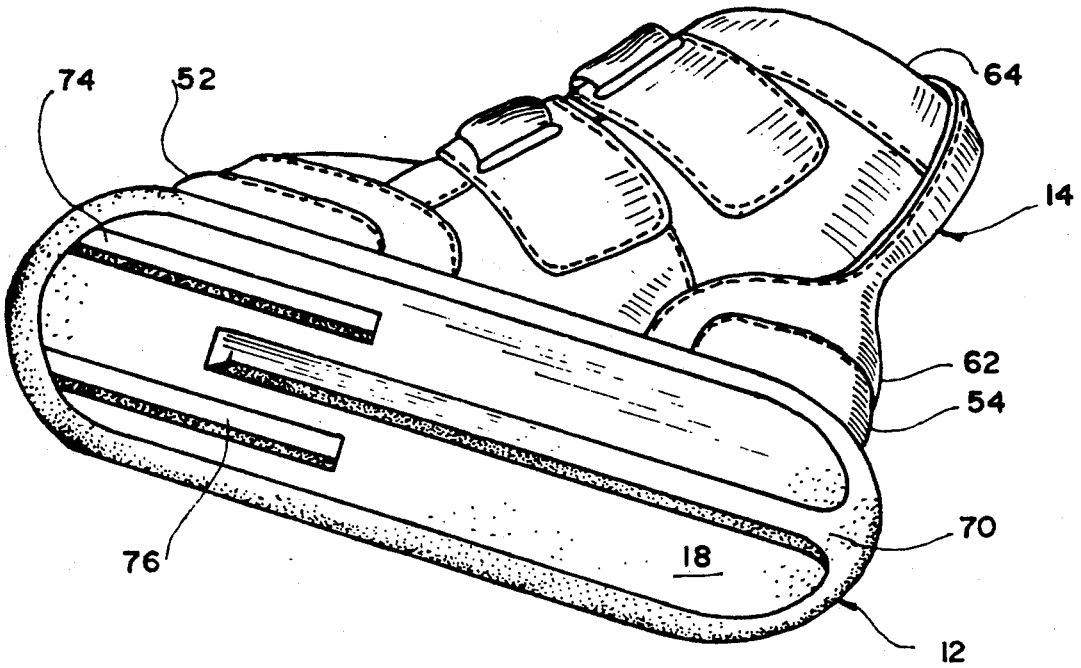
FIG. 2 is a bottom perspective view of the footwear shown in FIG. 1.

As further illustrated in FIGS. 2 and 4, the shoe sole plate 20 can have an additional pair of channel members 74 and 76, each channel 74 and 76 being carved into the undersurface 18 of the plate 20 and forming a channel which extends along substantially the forward front third of the surface 18, and somewhat overlaps in distance the primary central channel 70, as illustrated in FIG. 2. The pair of secondary channels 74 and 76 further define a means for providing ingress and egress of the pressurized water upon which footwear 10 is gliding, while the footwear is being utilized in a manner, wherein the skier is moving in a backwards mode. A pair of channels 74 and 76 would allow greater maneuverability and stability to the user.

The front 30 and the heel 34 portions are curved, so as to offer less resistance to a water flow and create less turbulence, while the bottom surface 18 contacts the body of water during water gliding process.

As can be seen in FIG. 3, the front portion 30 is curved upwardly to a degree substantially greater than the heel portion 34, wherein the upward curvature is not so pronounced.

The size of the water sport footwear 10 can vary, depending on the actual size of a sportsman's foot who uses the footwear in accordance with the present invention. Still, the proportions between the boot portion 14 and sole portion 12 are retained, so as to allow more freedom of movement for the user of the water sport footwear 10, while not restraining his movement, in giving the illusion of "barefoot skiing" with the protection to the foot that that sport cannot provide. The footwear is shaped slightly different for a left and a right foot, generally following the natural shape of human feet.

In operation, a sportsman secures the boot portion 14 about his foot, tightening the securing strap 66 and 68, when necessary, so as to completely cover his foot and the ankle, thus preventing accidental removal of the footwear during water gliding process. A conventional propelling means, such as a motor boat, is employed for towing and propelling the sportsman when he starts the water gliding process by placing his feet with bottom surface 18 on the surface of water, thus starting the gliding process in the footwear itself, without the use of water ski shoes and/or water skis of any kind. During the entire water gliding process the water sport footwear 10 is secured on the foot of the sportsman, allowing him to perform various stunts, if desired, while not restricting his movements to any degree.

As will be appreciated, the boot portion 14 can vary in design, size, color or the material from which it is made. Some of the applications contemplate the use of water impermeable material for the boot portion 14, while other applications utilize, at least in part, water permeable materials for the boot portion 14. The plate 22 is made from substantially rigid plastic, such as polyurethane, which retains its shape during impact with the surface of water, does not easily deform, but still allows formation of various required curvatures in the shape of the sole, while the plate 20 is made from a soft, flexible resilient material, such as for example polyurethane with much less density than that used for plate 22, for defining a cushion to help absorb impacts between the ski shoe and objects, which would further resist in the tearing or breaking of rigid support surface 22 during use. The lower plate 20 is able to absorb greater impact with the water, yet serve as a means, with utilization of continuous peripheral boarder 78, to protect direct impact to the upper plate 22 during use of the water sport footwear 10. Therefore, the user is provided with greater stability and safety during use.

Many changes and modifications can be made in the design of the present invention without departing from the spirit thereof. I, therefore, pray that my rights to the present invention be limited only by the scope of the appended claims.

I claim:

1. A water sport footwear, comprising:

an upper shoe portion for accommodating a foot of a wearer;

a sole assembly secured to the shoe portion along entire length of the shoe portion, the sole assembly further comprising:

a solid upper rigid plate having a top surface;

a lower flexible impact absorbing plate fixedly attached to the upper rigid plate, said lower plate having a top surface which is provided with a recess, the recess being sized and shaped to receive the upper plate therein; and a continuous integral shoe portion mounting wall extending upwardly from the upper rigid plate and defining an area within which the shoe portion is secured, the mounting wall being integrally formed with the upper plate, and wherein a continuous outwardly extending border is formed between outer peripheral edges of the upper plate and outer peripheral edges of the mounting wall, said border being formed, at least in part, by the top surface of the upper plate.

2. The apparatus of claim 1, wherein a continuous boarder is formed between outer peripheral edges of the lower plate and outer peripheral edges of the upper plate.

3. The apparatus of claim 1, wherein said upper plate and said lower plate are fused together to form a composite unitary sole platform.

4. The apparatus of claim 1, wherein said lower plate is provided with channel means formed in a bottom surface thereof for allowing water to flow therewithin and be delivered rearward of the footwear.

5. The device of claim 1, wherein the sole assembly comprises an upwardly curved front part and an upwardly curved heel part, while the front part is curved upwardly to a degree at least slightly greater than the heel part.

6. The apparatus of claim 1, wherein the upper plate comprises an arch part which is curved upwardly to accommodate natural curvature of a human foot.

7. The apparatus of claim 1, further comprising a strap means extending across the foot of the wearer on the shoe portion for securing the foot of the wearer in the shoe portion during use.

8. A water sport footwear, comprising:

an upper shoe portion for accommodating a foot of a wearer;

a sole assembly secured to the foot portion along entire length of the shoe portion, the sole assembly further comprising an upper rigid plate having an arch part which is curved upwardly to accommodate natural curvature of a sole of a sportsman's foot;

a lower flexible impact absorbing plate fixedly secured to the upper plate, said lower plate having a top surface which is provided with a recess sized and shaped to receive bottom and sides of the upper plate in a fixed attachment thereto, while a continuous outwardly extending border is formed between outer peripheral edges of the lower plate and outer peripheral edges of the upper plate said sole assembly further comprising a continuous integral shoe portion mounting wall extending upwardly from an upper rigid plate and unitary formed therewith, said wall defining an area within which the shoe portion is secured to the upper plate, said upper plate forming an outwardly extending second continuous border formed between peripheral edges of the mounting wall and the outer peripheral edges of the upper plate.

9. The footwear of claim 8, wherein the upper plate, the lower plate and the mounting wall are formed as a composite unitary sole assembly.

* * * * *